United States Patent [19]

Meyer

[11] Patent Number: 4,800,816

[45] Date of Patent: Jan. 31, 1989

[54] DELAY DISCARDING SABOT PROJECTILE

[75] Inventor: David A. Meyer, Plymouth, Minn.

[73] Assignee: Honeywell Inc., Minneapolis, Minn.

[21] Appl. No.: 102,320

[22] Filed: Jul. 30, 1987

Related U.S. Application Data

[63] Continuation-in-part of Ser. No. 562,352, Dec. 16, 1983, abandoned.

[51] Int. Cl.[4] ..... F42B 13/16

[52] U.S. Cl. ..... 102/523

[58] Field of Search ..... 102/520–523

[56] References Cited

U.S. PATENT DOCUMENTS 2,382,152 8/1945 Jakobsson ..... 102/523

3,446,147 5/1969 Engel et al. ..... 102/522

3,948,184 4/1976 Pierre et al. ..... 102/522

FOREIGN PATENT DOCUMENTS 704406 3/1941 Fed. Rep. of Germany ..... 102/520

2420116 11/1979 France ..... 102/520

*Primary Examiner*—Harold J. Tudor

*Attorney, Agent, or Firm*—Roger W. Jensen

[57] ABSTRACT

A low dispersion delay discarding sabot projectile comprising a full caliber cylindrical pusher having a forward facing cylindrical recess, a cylindrical subcaliber penetrator positioned in the recess with a significant annular gap defined therebetween, and a discarding sabot of light weight material disposed in said annular gap.

11 Claims, 3 Drawing Sheets

DELAY DISCARDING SABOT PROJECTILE

This application is a continuation-in-part of application Ser. No. 562,352, filed Dec. 16, 1983 now abandoned.

BACKGROUND OF THE INVENTION

This invention relates to delay discarding sabot projectiles which are well known in the field of ordnance and may be defined as a discarding sabot projectile comprising in part a subcaliber core or projectile coacting with a full caliber pusher (sometimes referred to as a carrier) and including further means for delaying the axial separation between the pusher and the projectile until the assembled pusher/projectile has been shot from the muzzle of a rifled gun barrel and traveled a predetermined distance from the muzzle. A delay discarding sabot projectile is used as ammunition for automatic guns carried on aircraft. It is important, to prevent damage and/or destruction to the aircraft, to keep the pusher/sabot/projectile assembly intact until the assembly is a safe predetermined distance ahead of and/or away from the aircraft, whereat the pusher and projectile axially separate with the penetrator continuing its trajectory and with the parts of the carrier and sabot following a predictable flight to the ground without risk of collision with the aircraft from which the assembly was fired.

A significant problem with prior art delay discarding sabot projectiles has been difficulty in maintaining predictability of the time of separation, i.e., the distance traveled by the assembled pusher/sabot/projectile from the aircraft before the axial separation of the pusher and the penetrator. Those skilled in the art recognize that the pusher has relatively high aerodynamic drag. Thus, the relatively high velocity of the full caliber pusher and assembled projectile at the time of ejection from the gun barrel immediately begins diminishing as the assembled pusher/detonator/penetrator travels through the air. If the axial separation between the pusher and the penetrator occurs too quick or early, i.e., prior to the desired separation point, then there are two adverse results. The first is, as aforesaid, the debris of separation, i.e., the metal pusher and/or discarding sabot may strike the delivery aircraft, e.g., being ingested into the engines or otherwise causing harm and possible destruction to the aircraft. The second problem associated with early axial separation of the pusher and the penetrator is that the penetrator (following separation) will have a higher velocity than planned or intended and accordingly will probably miss the target, i.e., will probably overshoot the target. If the axial separation between the pusher and the penetrator occurs too late, i.e., after the desired separation point, then the assembled pusher/-penetrator will have decreased substantially in velocity so that the penetrator velocity, after separation, will be too slow and the penetrator will fall short of the intended target.

Thus, a key object of this invention is to provide an improved delay discarding sabot projectile having significantly increased hitting accuracy by accurately controlling the time/distance from the aircraft of the actual axial separation between the pusher and the penetrator, a collateral object being to provide a safe apparatus so that there will not be danger for the delivery aircraft all as aforesaid.

Prior art delay discarding sabot projectiles has typically taken the form of a metal pusher having a forward facing recess surrounding a high density metal penetrator, both pusher and penetrator typically being right circular cylindrically shaped members. The prior art pusher typically had a pyrotechnic delay column and expulsion charge adapted to explode after the assembled pusher/penetrator has been ejected from the gun barrel so as to axially separate the penetrator from the pusher. The inherent problem with the prior art configuration was that there could, because of normal machining-/manufacturing variations, be significant differences in dimensions between the outer diameter of the penetrator and the inner diameter of the aforesaid recess. The difference in dimensions vary from round to round and hence result in a substantial variation of release forces, i.e., the forces tending to hold the penetrator within the pusher. This uncontrollable variation in release force accordingly would dramatically and significantly change the separation point from one round of ammunition to another, greatly reducing the overall accuracy, i.e., failing to produce a projectile having a low dispersion factor. My invention has solved this problem in a unique manner, i.e., producing a projectile that can be made on a low cost mass production basis and having a very high accuracy, i.e., a low dispersion factor.

SUMMARY OF THE INVENTION

My invention provides a high accuracy, i.e., low dispersion delay discarding sabot projectile comprising a full caliber pusher having a cup-like forward facing recess; a cylindrically shaped subcaliber penetrator positioned in the recess (the pusher and penetrator longitudinal axes being aligned with the recess having an inner diameter substantially larger than the outer diameter of the penetrator so that, when the penetrator is positioned in the pusher, as aforesaid, an annular gap is defined therebetween. The invention further includes a discarding sabot of light weight frangible, non-resilient material disposed (e.g., by plastic molding processes) in the annular gap.

My invention provides consistent separation forces between the penetrator and the pusher, because the plastic sabot fills the annular gap between the penetrator and the pusher, regardless of the exact size of either pusher or penetrator. Thus the dimensional variations of the pusher and penetrator will result only in variations of the radial thickness of the plastic sabot. Therefore, my invention provides a means to predict with great accuracy the separation force to thereby provide the desired high accuracy and low dispersion.

DESCRIPTION OF THE DRAWINGS

FIG. 8 is a cross-sectional view of the nose portion of an assembled penetrator and pusher, showing a modification of my invention;

FIG. 9 is a showing of another modification of my invention, i.e., a partial longitudinal cross-sectional view of the forward portions of an assembled pusher, sabot and penetrator;

FIG. 10 is a cross-sectional view of the apparatus of FIG. 9 as viewed along section lines 10—10 of FIG. 9;

FIG. 11 is a showing of the apparatus of FIG. 9 after the penetrator has begun to separate from the assembled pusher and sabot;

FIG. 12 is an end view of FIG. 9; and

FIG. 13 is a showing of a complete round of ammunition comprising in part my improved delay discarding sabot projectile.

DESCRIPTION OF THE PREFERRED EMBODIMENT

Figure 1:
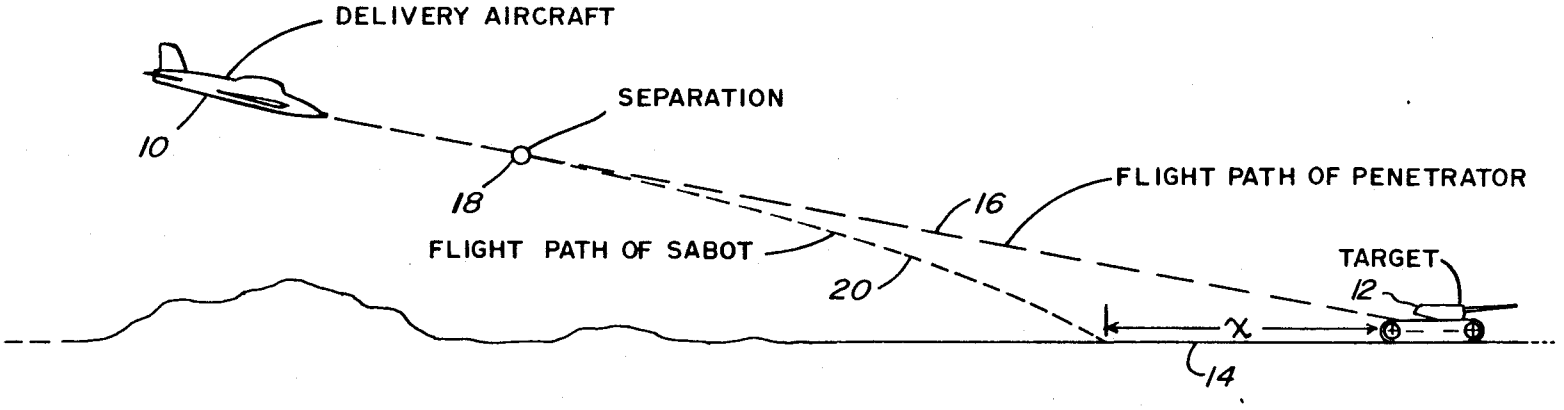
FIG. 1 is a diagram of a delivery aircraft attacking a target.

Referring to FIG. 1, a delivery aircraft 10 is shown generally aimed at a target 12, e.g., an armored tank traversing a ground plane 14, the effective aiming line, i.e., the desired flight path of a penetrator fired from the aircraft being identified by reference numeral 16. Reference numeral 18 designates a desired point of separation between the penetrator and the pusher, this point being preselected so as to provide safety to the aircraft, as aforesaid, and also to leave the penetrator with the desired velocity at time of separation so that it will continue on flight path 16 so as to strike the target 12. Reference numeral 20 designates the flight path of the sabot which, as aforesaid, has significantly increased aerodynamic drag as compared to the drag of the penetrator which results in the velocity of the sabot/pusher being significantly reduced. Thus, the sabot/pusher (sans the penetrator) will impact the earth plane 14 a significant distance away from the target 12. Those skilled in the art will understand that if the separation between the penetrator and the sabot/pusher occurs too soon, i.e., before the optimum separation point 18, the penetrator will probably overshoot the target and, conversely, if the separation occurs too late, i.e., after separation point 18, the penetrator will probably fall short of the target.

Figure 2:
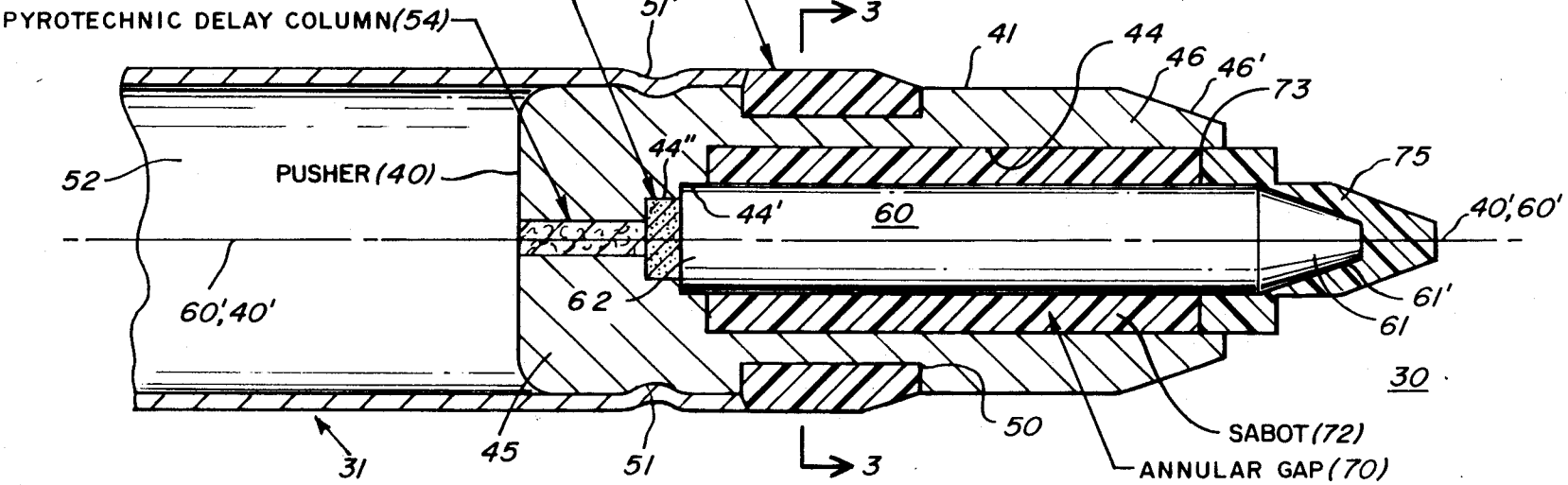
FIG. 2 is a longitudinal cross-sectional view of my improved delay discarding sabot projectile.

In FIG. 2, reference numeral 30 generally designates my improved delay discarding sabot projectile comprising in part a pusher 40 and a projectile 60. More specifically, the pusher 40 is a full caliber right circular cylindrically-shaped member fabricated, in a preferred embodiment, out of an aluminum alloy. The pusher 40 has a substantial longitudinal extent, an exterior cylindrical surface identified by reference numeral 41, and a longitudinal axis 40'. Pusher 40 has a cup-like forward facing recess 44 which is substantially concentric with the external surface 41, the pusher further having an aft end portion 45 and a front end portion 46. A radially inwardly extending groove 50 or band slot in the outer periphery or exterior surface 41 of the pusher has a significant longitudinal extent and is adapted to receive a plastic rotating band 80. The band 80 is a means for coacting with rifling means in a gun barrel so as to impart a spin to the pusher as it travels along the gun barrel. The aft end 45 includes on the outer radial periphery thereof a detent portion 51 to coact with the crimped end 51' of the forward end 31 of a shell casing partially shown in FIG. 2 and identified by reference numeral 52.

The aft end 45 further includes a centrally located pyrotechnic delay column 54 extending from the extreme aft end axially or longitudinally forward to abut against an expulsion charge 56 disposed a first sub-recess 44" of recess 44.

Penetrator 60 is a right circular cylindrically-shaped subcaliber member of dense material (e.g., tungsten alloy or depleted uranium) having a preselected longitudinal length, which in the preferred embodiment, is selected so that when the penetrator is positioned within the aforedescribed recess 44 of the pusher, the nose portion of the penetrator will project forward of the most forward portion, i.e., front end portion 46 of the pusher, this being the arrangement depicted in FIG. 2. The longitudinal extent of said recess is at least 75% of the longitudinal length of said penetrator, but is not as great as the longitudinal length of said penetrator. Thus, the penetrator 60 has a front end or nose portion 61 shown to have a conical or pointed shape and an aft end 62 adapted to sit in a second sub-recess 44' of recess 44 of the pusher 45, the aft end of the penetrator 60 thus being retained in a radially fixed position with respect to the aft end of pusher 45. The penetrator 60 has a longitudinal axis 60'; the apparatus of FIG. 2 is designed so that the longitudinal axes 40' and 60' will be coaxial or aligned, it being understood that all of the primary surfaces depicted in FIG. 2 are either coaxial with the axis 40'/60' or are at an angle thereto. For example, the external surface 41 of pusher 40 is, as aforesaid, concentric with axis 40'.

It will be noted from FIG. 2 that the outer diameter of penetrator 60 is substantially less than the inner diameter of the recess 44 within the pusher 40, an annular gap 70 thereby being defined between the outer surface of the penetrator 60 and the inner surface 44 of the pusher 40.

A sabot of light weight material 72 is disposed, through the use of plastic molding procedures, in the annular gap 70 around all or substantially all of the longitudinal extent of the penetrator 60. The material selected for the discarding sabot may be from a group of materials that are light weight and relatively frangible, a plastic material which has been found very satisfactory and is used in my preferred embodiment being glass reinforced nylon. As shown in FIG. 2, the plastic sabot extends axially or longitudinally forward to a point 73 slightly aft of the front end portion 46 of the pusher 40. A second part of the sabot is a cap surrounding the nose portion 61 of the penetrator, this second sabot portion or cap being identified by reference numeral 75.

Figure 3:
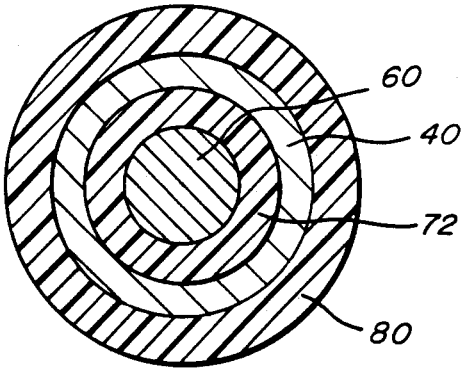
FIG. 3 is a cross-section of the apparatus shown in FIG. 2 as viewed along section lines 3—3.
Figure 6:
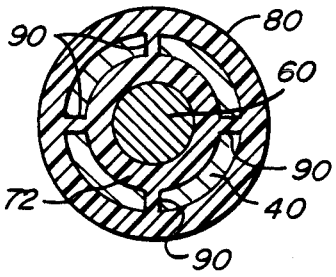
FIG. 6 is a cross-sectional view of the apparatus of FIG. 4 as viewed along section line 6—6.

The plastic rotating band 80 shown in FIG. 2 may be fabricated, during the production process, independently of the molding of the plastic sabot 72 by suitable means which are not directly related to this invention. Such independence is confirmed by FIG. 3. However, it may be advantageous to form the plastic rotating band 80 simultaneously with the fabrication of the plastic sabot 72, this being depicted in the modification of FIGS. 4 and 6 where it is seen that there are one or more apertures, holes or passageways 90 radially extending between recess 44 and the annular rotating band seat or groove 50 in the outer periphery of pusher 40. Those skilled in the art of plastic molding will understand the advantage of this arrangement which greatly facilitates the flow of the plastic material (during the molding process) throughout the entire annular gap 70, thence through the passageway(s) 90 to the zone and means which, during the molding process, define the rotating band 80.

Figure 4:
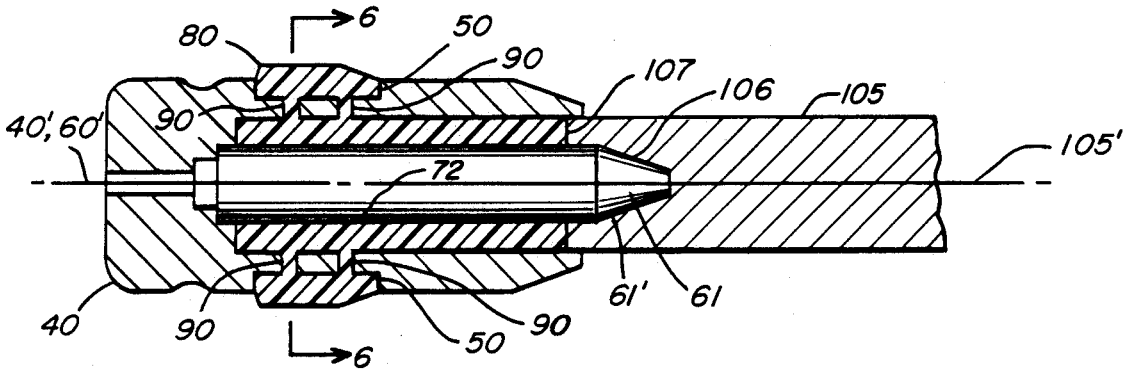
FIG. 4 is a longitudinal cross-sectional view of a modified apparatus of the type shown in FIG. 2 in combination with a molding core pin which may be used in the molding of the plastic sabot.
Figure 5:
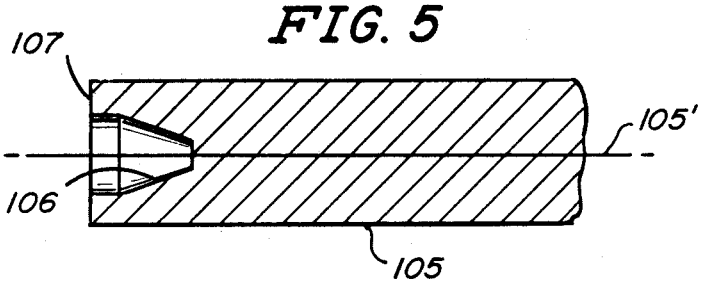
FIG. 5 is a separate view of the molding core pin of FIG. 4.

FIG. 4 also shows one arrangement for supporting the forward nose or front end portion 61 of the penetrator 60 during the plastic molding process, this means being depicted as a molding core pin 105 (shown separately in FIG. 5) having at one end thereof a conically shaped recess 106 having a profile selected to provide clearance for the conical tip 61 of the penetrator 60 and snugly receive a preselected amount of the longitudinal portion of the penetrator 60. Reference numeral 107 designates the left end of core pin 105, this being a surface which is substantially perpendicular to the longitudinal axis 105' of the core pin 105. The core pin 105 further has an outer diameter which is selected (for this embodiment) so that the left end of the core pin 105, as shown in FIG. 4, may be snuggly inserted into the right end of the recess 44 of the pusher 40.

Figure 7:
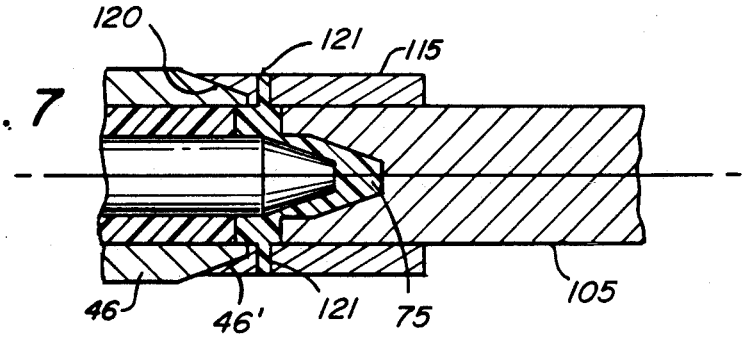
FIG. 7 is a showing of apparatus for making a second injection so as to mold the nose piece around the nose of the projectile.

FIG. 7 shows the core pin 105 in a second position to facilitate the molding of the end cap 75, the core pin 105 being displaced to the right, from the position depicted in FIG. 4, a preselected amount and thereat being fixed during the molding of the cap 75, the molding being facilitated by a sleeve 115 connected by some appropriate means to core pin 105 and having a beveled recess 120 at the left end thereof adapted to receive the beveled surface 46' on the front end portion 46 of the pusher 40. The sleeve 115 further has means such as ports 121 for facilitating the flow therethrough of plastic material to form the nose cap 75.

FIG. 8 shows a further modification of my invention where a modified core pin 205 has a conical recess extending to the outer periphery thereof; this will produce a beveled junction between the first injection 172 and the second injection 175 of the discarding sabot. The alternate core pin design of FIG. 8 could provide a better aerodynamic shape for the projectile during the initial flight before separation, it being observed from FIG. 8 that the external surfaces of the nose cap 175 and the front end portion of the pusher 40, i.e., surface 46' are substantially aligned or streamlined. As before, the core pin would be first positioned within the recess 44 to provide a means for defining the first injection 172 of the sabot following which it would be displaced to the right to the position shown in FIG. 8 and supported by means not shown for the molding of the nose piece or nose cap 175.

The most desirable separation of the penetrator from the pusher is one which creates as little debris as possible. The arrangement shown in FIG. 9 achieves this result in that (i) the penetrator nose cap fractures so as to be released from the nose of the penetrator and from the remainder of the sabot and (ii) the penetrator slides out of the sabot 272 which remains inside of and assembled with the pusher body 240. In FIG. 9 the penetrator 60 may be the same as depicted in the earlier described embodiments; however, the pusher 240 is depicted as having near the forward end of the recess a radial annular groove 241 into which flows plastic material during the molding process of the sabot 272 thus forming an annular shoulder 273 (after hardening of the plastic material) thereby longitudinally fixing the sabot 272 with respect to the pusher 240. Thus at the instant of desired separation of the penetrator, the expulsion charge 56 will generate gases which will push against the aft end of the penetrator and the penetrator will axially separate from the sabot 272. Therefore, after separation of the penetrator from the pusher/sabot, substantially all of the sabot is retained attached to the pusher, only the nose cap 275 being carried by the penetrator (see FIG. 11). Further, the nose portion 275 of the sabot has one or more slots 276 so as to facilitate the breakup of the nose portion into small fragments at the time the penetrator begins to axially separate from the pusher. Slots 276 are best viewed in FIG. 12.

FIG. 11 shows the apparatus of FIG. 9 with the penetrator moved axially forward from the position of FIG. 9; in this view it will be noted that the main body of the sabot 272 has been retained within the pusher 240 and that the penetrator has moved forward but with the nose cap still in place on the nose of the penetrator following which the nose cap will break up under the combined effects of centrifugal force caused by the spinning of the penetrator (as is well understood by those skilled in the art) and/or by the immediately preceding mechanical shock of the separation of the nose cap from the remainder of the sabot.

FIG. 13 shows a complete round of ammunition comprising my improved delay discarding sabot projectile 30 assembled with a shell casing 31, the specifics of which form no direct part of my invention.

While I have described the preferred embodiment of my invention, it will be understood that the invention is limited only by the scope of the following claims:

I claim:

1. A low dispersion delay discarding sabot projectile comprising:

(a) a full caliber right circular cylindrically shaped pusher having a preselected longitudinal length and having a cup-like forward facing recess substantially concentric with the external surface of said pusher, said pusher having an aft end portion and a front end portion and said recess having a preselected longitudinal extent;

(b) a right circular cylindrically shaped subcaliber penetrator of dense material and having a preselected longitudinal length, an aft end, a front end nose portion, and positioned in said recess of said pusher so that (i) said penetrator aft end is in abutting relationship with said aft end portion of said pusher and (ii) the pusher and penetrator longitudinal axes are aligned, said recess further having an inner diameter substantially larger than the outer diameter of said penetrator so that, when said penetrator is positioned in said pusher, as aforesaid, an annular gap is defined therebetween, and said longitudinal extent and length of said recess and penetrator being respectively preselected, as aforesaid, so that, the longitudinal extent of said recess (i) is at least 75% of the longitudinal length of said penetrator, but (ii) is not as great as the longitudinal length of said penetrator, thereby, when said penetrator is positioned in said recess, as aforesaid, said nose portion of said penetrator projects beyond said front end portion of said pusher;

(c) a sabot of non-resilient material disposed in said annular gap substantially the entire longitudinal length of said penetrator; and (d) expulsion means in said aft end portion of said pusher for axially separating said penetrator from said pusher at a preselected time.

2. Apparatus of claim 1 further characterized by said pusher aft end portion and said penetrator aft end having coacting means for retaining said penetrator aft end radially fixed with respect to said pusher aft end portion.

3. Apparatus of claim 1 further characterized by said pusher/penetrator axial separation means comprising pyrotechnic delay means and explosive charge means positioned in the aft end of said pusher.

4. Apparats of claim 1 further characterized by said pusher having a rotation band attached thereto.

5. Apparatus of claim 1 further characterized by said sabot having a forward nose portion enclosing said penetrator front end nose portion.

6. Apparatus of claim 5 further characterized by said sabot forward nose portion having a right conical external surface having a longitudinal axis aligned with the longitudinal axes of said pusher and penetrator.

7. Apparatus of claim 1 further characterized by said pusher front end portion having a right conical external surface.

8. Apparatus of claim 1 further characterized by said pusher front end portion having a right conical external surface, and by said penetrator front end nose portion being enclosed by said sabot.

9. Apparatus of claim 8 further characterized by said sabot having a front end portion having a right conical external surface.

10. Apparatus of claim 9 further characterized by said right conical external surfaces of said pusher and sabot being longitudinally displaced.

11. Apparatus of claim 10 further characterized by said sabot conical surface being forward of said pusher conical surface, and in streamlined relationships whereby said conical surfaces provide an efficient aerodynamic shape.

* * * * *

UNITED STATES PATENT AND TRADEMARK OFFICE

CERTIFICATE OF CORRECTION

PATENT NO. : 4,800,816

DATED : January 31, 1989

INVENTOR(S) : DAVID A. MEYER

It is certified that error appears in the above-identified patent and that said Letters Patent is hereby corrected as shown below:

The sheets of drawings consisting of Figs. 8, 9, 10, 11, 12 and 13, should be added as shown on the attached sheets.

Signed and Sealed this

Seventh Day of November, 1989

*Attest:*

JEFFREY M. SAMUELS

*Attesting Officer*

*Acting Commissioner of Patents and Trademarks*

UNITED STATES PATENT AND TRADEMARK OFFICE

CERTIFICATE OF CORRECTION

PATENT NO. : 4,800,816

DATED : January 31, 1989

INVENTOR(S) : DAVID A. MEYER

It is certified that error appears in the above-identified patent and that said Letters Patent is hereby corrected as shown below:

FIG. 8

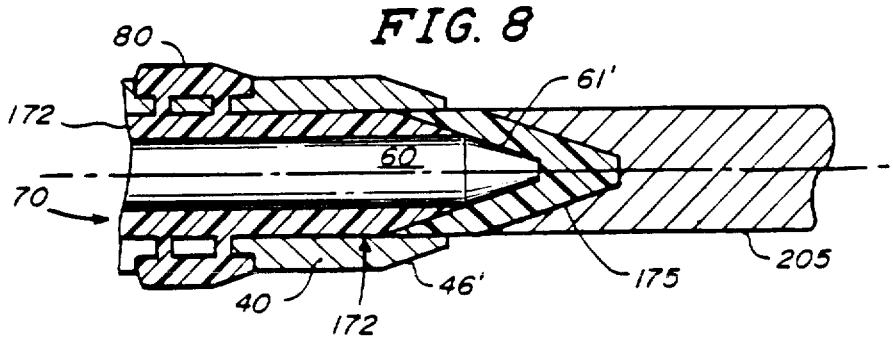

FIG. 9

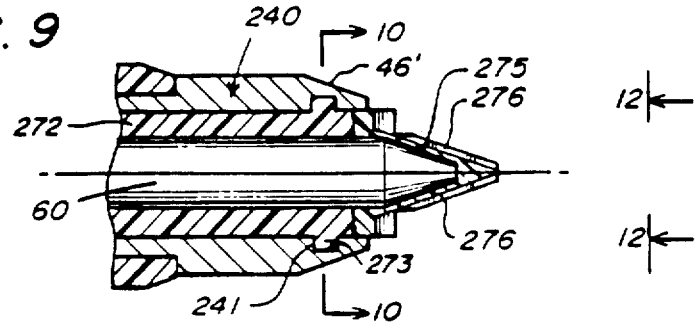

UNITED STATES PATENT AND TRADEMARK OFFICE

CERTIFICATE OF CORRECTION

PATENT NO. : 4,800,816

DATED : January 31, 1989

INVENTOR(S) : DAVID A. MEYER

It is certified that error appears in the above-identified patent and that said Letters Patent is hereby corrected as shown below:

FIG. 11

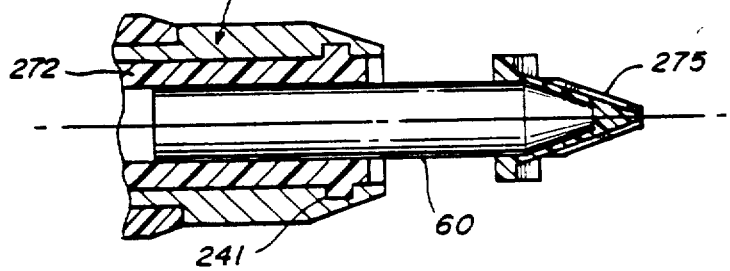

FIG. 10

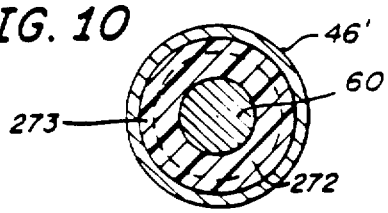

FIG. 12

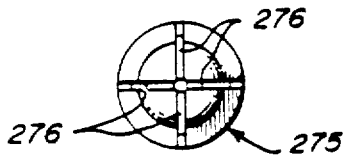

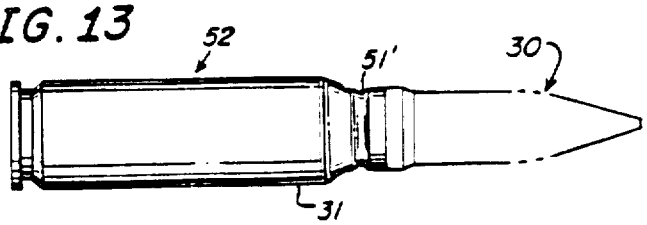

FIG. 13